US005491542A

United States Patent [19]

Nagashima et al.

[11] Patent Number: 5,491,542

[45] Date of Patent: Feb. 13, 1996

[54] DEVELOPER SUPPLYING CONTAINER AND ASSEMBLING METHOD THEREOF

[75] Inventors: Toshiaki Nagashima, Yokohama; Kunihiko Kitayama, Kawasaki; Kiyoshi Oyama, Tokyo, all of Japan

[73] Assignee: Canon Kabushiki Kaisha, Tokyo, Japan

[21] Appl. No.: 254,760

[22] Filed: Jun. 6, 1994

[30] Foreign Application Priority Data

Jun. 10, 1993 [JP] Japan ..... 5-163813
May 20, 1994 [JP] Japan ..... 6-106814

[51] Int. Cl.[6] ..... G03G 15/06

[52] U.S. Cl. ..... 355/260; 222/DIG. 1

[58] Field of Search ..... 355/260; 222/DIG. 1; 141/364; 206/216

[56] References Cited

U.S. PATENT DOCUMENTS

| | | | |
|---|---|---|---|
| 4,573,614 | 3/1986 | Ozawa | 222/DIG. 1 X |
| 4,614,286 | 9/1986 | Yamaguchi et al. | 222/DIG. 1 X |
| 4,650,070 | 3/1987 | Oka et al. | 206/216 |
| 4,895,104 | 1/1990 | Yoshino et al. | 355/260 X |
| 4,930,684 | 6/1990 | Patterson | 222/325 |
| 4,931,838 | 6/1990 | Ban et al. | 355/260 |
| 5,263,517 | 11/1993 | Ishikawa et al. | 355/260 X |
| 5,294,963 | 3/1994 | Nakano et al. | 355/260 |
| 5,351,728 | 10/1994 | Ban et al. | 141/364 |

FOREIGN PATENT DOCUMENTS

| | | | |
|---|---|---|---|
| 0098525 | 1/1984 | European Pat. Off. . | |
| 0514168 | 11/1992 | European Pat. Off. | 355/260 |
| 1-223482 | 9/1989 | Japan | 355/260 |
| 1486885 | 9/1977 | United Kingdom . | |

*Primary Examiner*—William J. Royer
*Attorney, Agent, or Firm*—Fitzpatrick, Cella, Harper & Scinto

[57] ABSTRACT

A developer supply container includes a developer containing portion having an opening for supplying the developer therefrom; a shutter for closing the opening; a shutter support for supporting the shutter for movement between a closing position where the shutter closes the opening and an opening position where the shutter is retracted from the closing position to open the opening; and a seal mounted on such a side of the shutter as is faced to the opening.

16 Claims, 4 Drawing Sheets

DEVELOPER SUPPLYING CONTAINER AND ASSEMBLING METHOD THEREOF

FIELD OF THE INVENTION AND RELATED ART

The present invention relates to a developer supplying container for replenishing developer to a developing device of an image forming apparatus such as an electrostatic copying machine, printer or the like.

In such an image forming apparatus powdery toner is used as a developer. When the developer in the main assembly thereof is used up, the toner is supplied from a toner supplying container to the main assembly. The toner supplying container comprises a cylindrical or rectangular parallelepiped or the like main body made of synthetic resin material or the like and a seal for sealing an opening of the main body provided for permitting supply of the powdery toner to the developing device.

Most of conventional seals are in the form of an easy peel, which is bonded to the periphery of the opening by bonding material or by way of heat sealing or the like. The film is removed to permit the supply of the toner. With this system, the container can not be sealed after the toner has been supplied, and therefore, the toner remaining in the container may scatter and fall.

There are various types of a developer supplying container with a sliding type shutter. Such a container comprises a reciprocally slidable shutter, a capping member which is mounted to the opening of the container and which functions to guide the shutter, and a sealing member, disposed between the shutter and the capping member, for sealing the container. The opening of the container is opened by moving the slidable shutter to permit the toner in the container to be supplied into the main assembly. After the completion of the toner supply to the main assembly, the shutter is closed, so that the sealing of the container is reestablished, and therefore, even if some toner remains in the container, the container can be removed without the possibility of the toner scattering. The material of the sealing member in this case is for example, foamed polyurethane, foamed polyethylene, rubber, rubber sponge or another elastic material, which is compressed between the shutter and the capping member to provide the sealing.

Generally, in the case of the slidable shutter type container, the sealing member between the shutter and the capping member is in the form of a ring extended around the toner supplying opening. However, with this structure, a flange of the cap is required to have a portion to which the sealing member is bonded and a guiding portion for the shutter, with the result of the tendency of increasing the size of the capping member. When the developer hopper of the main assembly is large enough, it will not be a problem. However, the recent demand for the downsizing of the main assembly reduces the size of the developer hopper per se. Accordingly, the size of the supply opening formed in the space excluding the seal bonding portion and the shutter guiding portion is reduced. Then, the toner discharge becomes slow, and in addition, the toner filling into the toner container becomes also slow, because the supply opening is used also as a supply opening. Then, the amount of toner contained in the supply container has to be reduced, otherwise the time required to fill the toner during production, will have to be increased.

Additionally, in the case that the sealing member is bonded to the flange, it should not interfere with the shutter guiding portion from the standpoint of assembly operativity. However, the shutter compressing the sealing member is confined by the guiding portion, and therefore, the assured compression of the sealing member is difficult if the sealing member does not exist in the shutter guiding portion, or the shutter may be curved with the result of instable sealing property.

Recently, the toner is easily scattered because the particle size of the toner is reduced for the purpose of increasing the image quality, and therefore, a high sealing property is required where the shutter is provided.

There is a tendency that the volume capacity of the toner container is increasing from the standpoint of environmental problem (the number of toner bottles required for the toner supply is desirably reduced), and from the standpoint of improved operativity and reduced cost by decreasing the number of toner supplying actions. To meet this tendency, the toner supply opening is desirably large. However, larger opening means larger possibility of toner leakage or scattering during transportation or when the container falls. Therefore, the high sealing property at the shutter portion is further desired.

If the material of the sealing member or the compression ratio or the like is changed, the force required to open or close the shutter (drag) is increased with the result of poorer operativity. As a method of decreasing the drag, the sliding area between the shutter member and the capping member and the sealing member may be reduced. However, with this method, the configurations of various parts are significantly confined, which may lead to complicated mold structure, and therefore, cost increase or improper guiding for the sealing member with the result of instability in the sealing property.

SUMMARY OF THE INVENTION

Accordingly, it is a principal object of the present invention to provide a developer supplying container and an assembling method therefor, in which the sealing property is improved.

It is another object of the present invention to provide a developer supplying container and an assembling method thereof in which the shutter opening operativity is improved.

It is a further object of the present invention to provide a developer supplying container and an assembling method thereof in which the developer does not leak during transportation or during a toner supplying operation to the main assembly.

It is a yet further object of the present invention to provide a developer supplying container and an assembling method therefor in which the operativity is improved when the developer is supplied to the main assembly of the image forming apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 1:
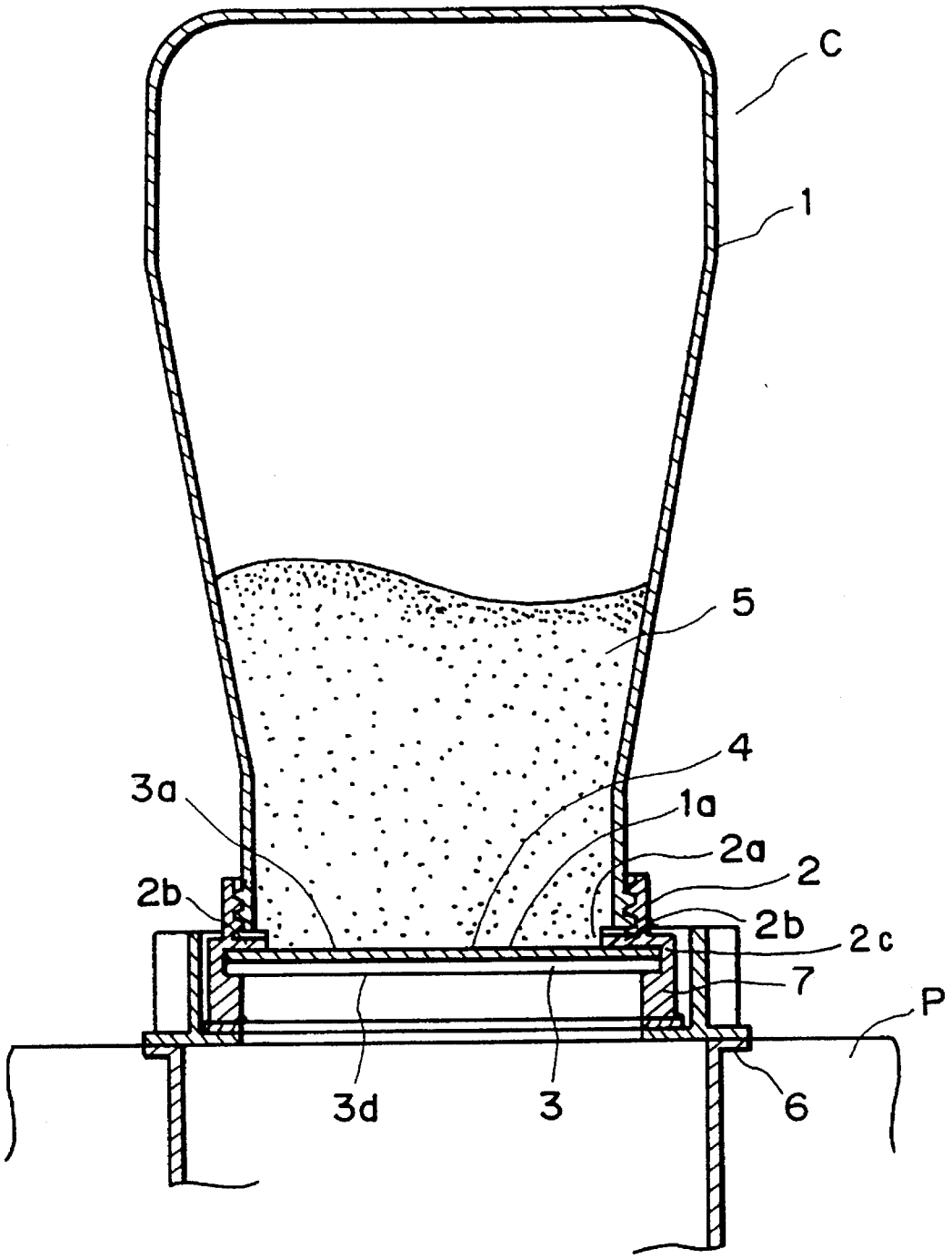
FIG. 1 is a side sectional view of a developer supplying container according to an embodiment of the present invention.
Figure 2:
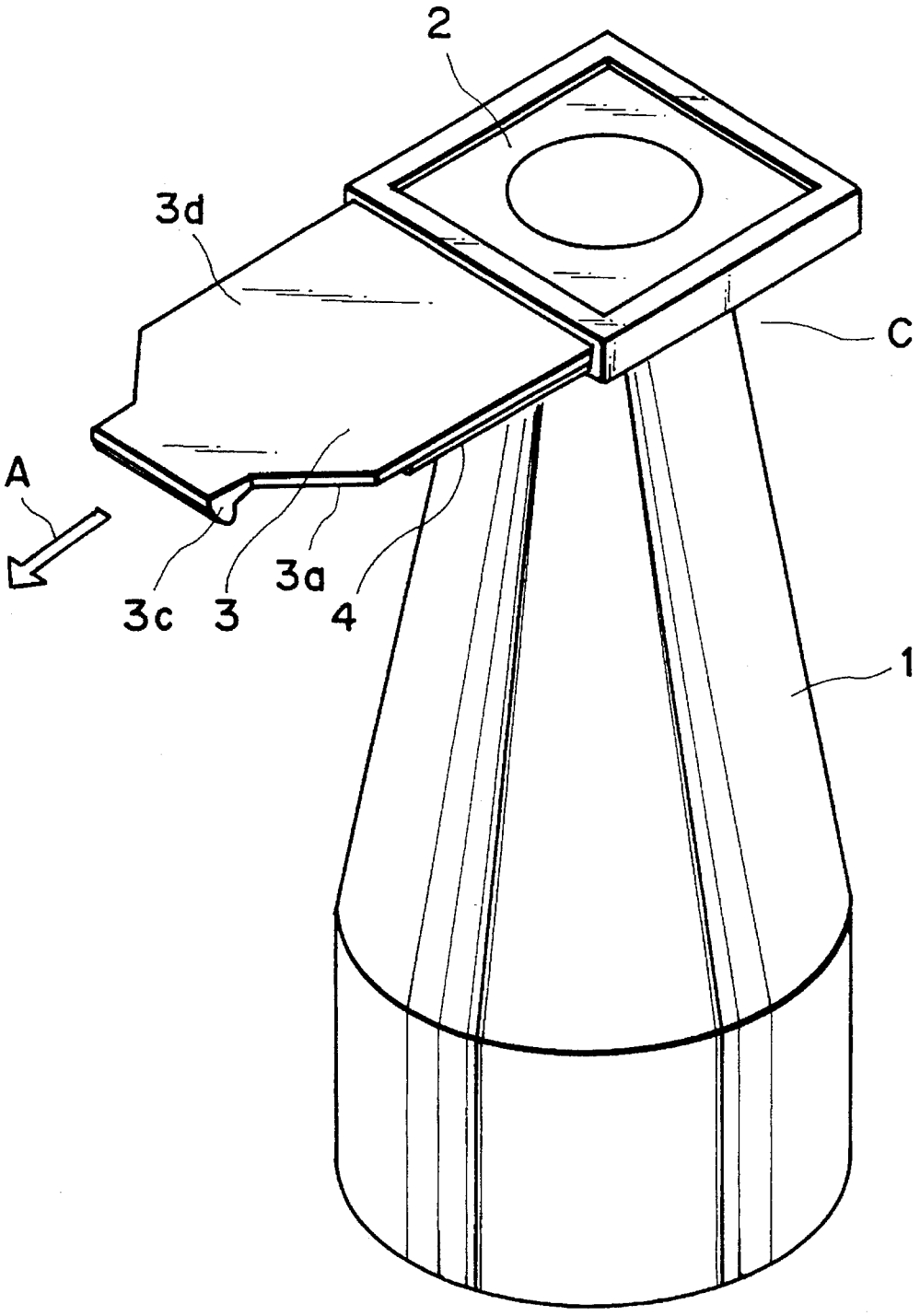
FIG. 2 is a perspective view of an outer appearance of the developer supplying container of FIG. 1.
Figure 3:
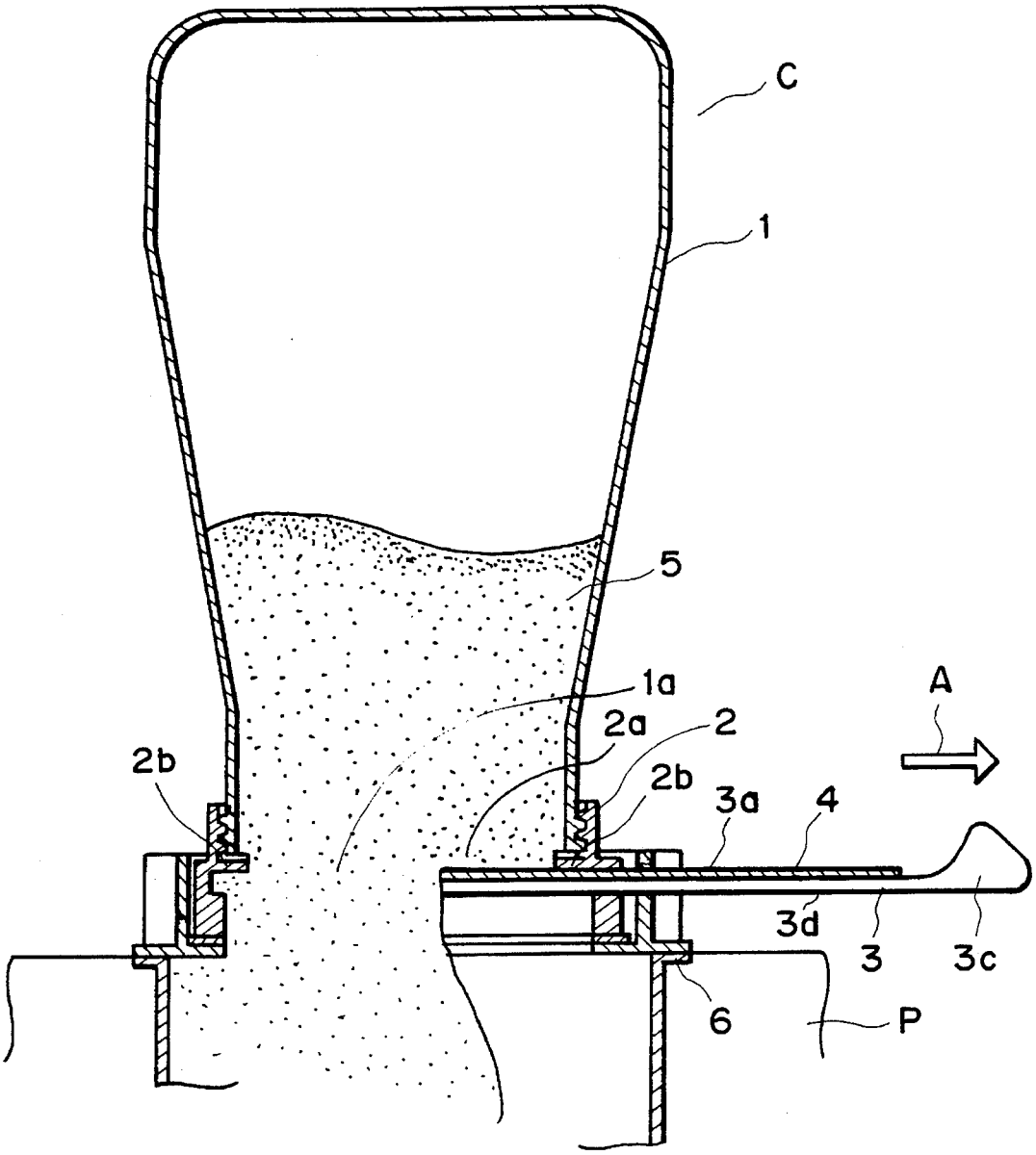
FIG. 3 is a side sectional view of the developer supplying container of FIG. 1 when the developer is being supplied into the image forming apparatus.

Referring to FIGS. 1–3, the description will be made as to a developer supplying container and an assembling method thereof according to an embodiment of the present invention.

Designated by a reference C is a developer supplying container of a slidable shutter type according to an embodiment of the present invention. As shown in FIG. 1, the sealing member 4 between the shutter 3 and the capping member 2 is mounted or bonded on substantially an entirety of a surface 3*a* of the shutter 3, corresponding to the opening 1*a* for the developer supply. By bonding the sealing member 4 to the surface 3*a* of the shutter, the sealing member 4 may extend into the shutter guiding portion 7 of the capping member 2, thus improving the stability of the sealing property.

More particularly, as shown in FIGS. 1–3, the developer supplying container C of this embodiment is provided with the opening for supplying the developer into a developer hopper 6 in the main assembly P of a copying machine. It comprises a container 1 for containing the developer, the shutter 3 for closing the opening 1*a*, a capping member 2 which supports the shutter for movement between a closing position where the shutter closes the opening 1*a* and an open position where the shutter is retracted from the closing position to open the opening 1*a*. The sealing member 4 is bonded on the surface 3*a* of the shutter 3 faced to the opening 1*a*. The capping member 2 comprises a guiding member 2*c* for guiding the shutter 3, at the opposite ends with respect to the movement direction of the shutter 3 (arrow A). The sealing member 4 extends between the opening 1*a* to the guiding member 2*c*.

The sealing member 4 is of soft elastic material to effect the sealing between the capping member 2 and the shutter 3. It functions to prevent leakage of the inside toner between the capping member 2 and the shutter 3 during falling or impact test or the like, and it is desirable that the resistance against the sliding movement with the flange surface having the opening 2*a* of the capping member 2, that is, with decreased drag. In consideration of these, the material of the sealing member 4 is silicone, urethane or the like rubber or sponge, and it is preferable that high density foam polyurethane resin having a hardness of 20–70 degrees, compression permanent set of 4% or smaller, friction coefficient of 0.8 or smaller, cell size of 60–300 μm and specific gravity of 0.2–0.5, is compressed by 5–50%. Further preferably, it is compressed by 10–30%.

The surface of the sealing member 4 is preferably smooth and the friction resistance is as small as possible. The bonding between the shutter 3 and the sealing member has bonding strength sufficient to avoid removal or offset upon the opening or closing of the shutter. Preferably, it is integrally molded by two-color (material) injection molding.

The shutter 3 is not broken or twisted in an impact test such as a falling test. It also has a rigidity sufficient to uniformly compress the sealing member 4. The sliding resistance relative to the capping member 2 is desirably small. In view of these, the preferable materials include polystyrene resin, polypropylene resin, ABS resin or another plastic resin material, or metal such as stainless steel.

As shown in FIGS. 1–3, the capping member 2 is mounted to the main assembly of the container 1, and comprises an opening 2*a* for permitting supply of the developer into a developer hopper 6 of the main assembly P of the copying machine, and a channel-like guiding member 2*c* for guiding the shutter 3. Where it is connected to the main assembly 1 of the container, the sealing is maintained. The material of the capping member 2 may be the same as that of the shutter.

Experiments have been carried out, wherein the materials of the main body 1 of the container, the capping member 2 and the shutter 3 are all polypropylene resin material, and the sealing member 4 is foamed urethane material, PORON available from INOAC Corporation, having a thickness of 2.5 mm. The sealing member 4, as described hereinbefore, is bonded to the shutter 3, and it is assembled with approx. 20% compression. As compared with the example shown in FIG. 4 in which the sealing member 4 is bonded to the capping member 2, the diameter of the developer supply opening can be increased by approx. 10 mm. As a result, the time required for completing the supply, is approx. 15 sec which is approx. one half the time required by the example of FIG. 4. In addition, for the preparation of a new container C with the toner, the time required for filling the container 1 with the toner can be reduced.

Opening tests have been carried out for 100 containers, and the force required for opening (drag) is 3–4 kg.f. The developer in the container is supplied into the developer hopper 6 with hardly any developer remaining in the container.

Vibration tests, pressure reduction tests, falling tests, high temperature and high humidity tests have been carried out as environmental and transportation tests, for 10 developer containers. It has been confirmed that no problem such as leakage of the developer is observed in any one of the tests. The image forming tests have been carried out, and it has been confirmed that no problem arises.

Referring to FIG. 3, the developer is being supplied to the developer hopper 6 of the main assembly P from the developer supply container C. As shown in FIG. 3, the operator opens the shutter 3 in a direction A by the grip 3*c*, in response to which the inside developer 5 is let fall into the developer hopper 6. The operator may push the shutter back to the closing position shown in FIG. 1, when, for example, the hopper 6 becomes full. Even in such a case, that is, the supplying operation is stopped with the developer remaining in the container, the opening 1*a* is sealed by the sealing member 4 bonded to the shutter 3 and the capping member 2, and therefore, the developer 5 does not leak or scatter. No developer scattering or the like is observed when the shutter 3 is closed and the container 1 is removed from the developer hopper 6, after supplying the developer to the hopper.

As will be understood from the foregoing, the method of assembling the developer supply container C is as follows. First, a container 1 capable of accommodating developer having an opening 1*a* for supplying the developer into the developer hopper 6 of the main assembly P of the copying machine is prepared. A shutter 3 for closing the opening 1*a* is prepared. A capping member 2 for supporting the shutter 3 for movement between the closing position for closing the opening and an open position for opening the opening 1*a* away from the closing position. An elastic sealing member 4 is mounted to the surface 2*a* of the shutter 3 faced to the opening 1*a*. When the sealing member 4 is mounted to the shutter, it is extended between the opening 1*a* and the capping member 2 for guiding the shutter 3.

Embodiment 2

Embodiment 2 of the present invention will be described. In this embodiment, the sealing member 4 is of urethane rubber, and it is integrally formed with the shutter 3 through two-color injection molding. In the other respects, the structures are the same as in Embodiment 1.

According to this embodiment, there is no need of bonding the sealing member, and therefore, the cost can be reduced.

The opening tests and the environment and transportation tests have been carried out for the containers of this embodiment, and it has been confirmed that no problem arises.

Comparison Example

Figure 4:
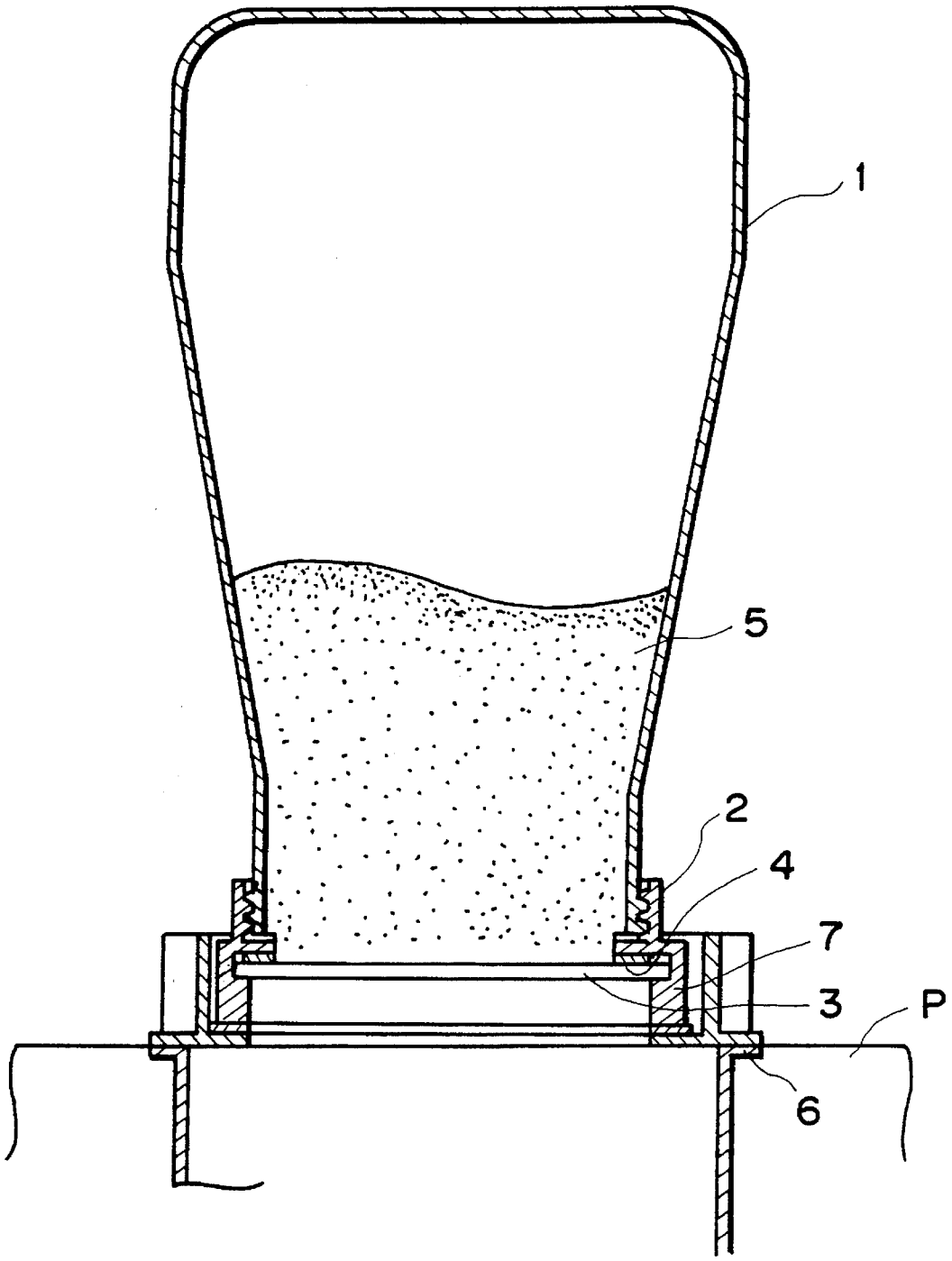
FIG. 4 is a side sectional view of a developer supplying container of a comparison example.

FIG. 4 is a sectional view of a container as a comparison, wherein a ring sealing member 4 is bonded to the capping member 2, corresponding to the peripheral portion of the developer supply opening 2*a*. A substantial area is required to which the sealing member 4 is bonded, and therefore, the developer supply opening 2*a* is smaller approx. by 10 mm than that of the first embodiment. The filling time period required is longer. If the same time period is permitted, the amount of filling has to be reduced by approx. 10%. The structure of the comparison example has been made the same as the embodiment except for the structure relating to this invention.

Embodiment 3

The description will be made as to preferable properties of the shutter 3 and the sealing member 4.

In the foregoing embodiments, a sealing member 4 between the shutter 3 and the capping member 2 is bonded to the surface of the shutter 4 faced to the opening of the developer supply opening 1*a* (FIGS. 1–3). Because of this, and because the sealing member 4 is extended into the shutter guide 7, the sealing property is stabilized. In addition, the necessity for the space for bonding the sealing material to the capping member 2, is eliminated. For this reason, the shutter guide 7 of the capping member 2 can be disposed right adjacent to the toner supply opening 1*a*, and therefore, the sealing property is further improved.

By assembling the container after the sealing member 4 is bonded to the shutter 3, the periphery of the developer supply opening 1*a* is brought into depressing engagement into the sealing member. This further improves the sealing property.

The sealing member 4 is of soft elastic material sufficient to maintain the sealing property between the capping member 2 and the shutter 3 such that the leakage of the developer does not occur in falling and impact tests or the like, and simultaneously, the sealing member 4 slides with small resistance relative to a flange surface 2*b* having the opening 2*a* in the capping member 2, by which the drag when opening the shutter 3 is small. In consideration of these, the material of the sealing member 4 is silicone, urethane or the like rubber or sponge, and it is preferable that high density foam polyurethane resin having a hardness of 20–70 degrees, compression permanent set of 4% or smaller, friction coefficient of 0.8 or smaller, cell size of 60–300 μm and specific gravity of 0.2–0.5, is compressed.

To meet the recent tendency of increased capacity of the toner container, the compression ratio and compression stress are desirably increased. If the compression ratio is small, the compression stress of the sealing member is small with the result of insufficient sealing property such that the developer leaks in the falling and impact tests or the like. Particularly, when the diameter of the developer supply opening is large as in the case of large capacity container or the like, the shutter member is relatively easily deformed by falling or impact. Therefore, with insufficient compression ratio of the sealing member, the sealing property may become instantaneously poor. However, if the compression ratio is too large, the compression stress of the sealing member is large with the result of higher sealing property, but simultaneously, with the result of increased drag. Therefore, the compression ratio and the compression stress are desirably adjusted in a proper range. It has been confirmed that the compression ratio of the sealing member 4 is preferably 5–50%, further preferably 20–40%. As to the compression stress of the sealing member, it is desirably 0.1 $kg/cm^2$–2.0 $kg/cm^2$, and even further preferably, it is 0.6 $kg/cm^2$–1.5 $kg/cm^2$ (JIS-K7220).

The surface of the sealing member 4 is preferably smooth and the friction resistance is as small as possible. The bonding between the shutter 3 and the sealing member has bonding strength sufficient to avoid removal or offset upon the opening or closing of the shutter. Preferably, it is integrally molded by two-color (material) injection molding.

The capping member is mounted to the main assembly of the container, and comprises an opening for permitting supply of the developer into a developer hopper of the main assembly of the copying machine, and a channel-like guiding member for guiding the shutter. Where it is connected to the main assembly of the container, the sealing is maintained. The material of the capping member may be polystyrene resin, polypropylene resin, ABS resin or another plastic resin material, or such material reinforced by glassifier, or metal such as stainless steel.

The shutter is not broken or twisted in an impact test such as a falling test. It also has a rigidity sufficient to uniformly compress the sealing member.

As described hereinbefore, with the increase of the compression ratio and the compression stress of the sealing member as a result of larger toner supply opening required by increase of the toner container capacity, the toner leakage tends to occur by deformation of the shutter supporting the sealing member. The shutter member is in the form of a plate, and therefore, it is more easily deformed than the capping member. Therefore, the rigidity of the shutter member is preferably high. This is so, also from the standpoint of preventing the increase of the drag and the trouble such as toner leakage.

If the bending elasticity of the shutter is small, the shutter deforms with the result of the above-described problems. However, if it is too large, it becomes brittle with the result of crack or break due to the shock during transportation or the like. In addition, there are a small number of materials which have very high bending elasticity, which are relatively expensive.

For these reasons, in this embodiment, the bending elasticity of the shutter 3 is properly selected, more particularly, the material of the shutter 3 has the bending elasticity of the 20,000 $kg/cm^2$–100,000 $kg/cm^2$, further preferably 50,000 $kg/cm^2$–80,000 $kg/cm^2$ (JIS-K7203).

The material of the shutter member 3 may be similar to that of the capping member 2 under the above conditions are satisfied.

In order to decrease the drag to increase the operativity while maintaining the high sealing property, a low friction material is disposed on a surface of the shutter member which is opposite from that having the sealing member. Particularly when the diameter of the developer supply opening is large as in the case of large capacity container, the sizes of the shutter member and the capping member are also large, and the sliding area upon shutter movement is also large, and therefore, the use of the low friction material is the most practical way of decreasing the drag.

When the reduction of the friction is considered, the selection of the material to be applied is not freely selected because the toner is in contact with it before the toner is supplied out. The possibility of the peeling or crack or the like of the applied material is also taken into account. When a low resistance film or the like is bonded, the deformation of the sealing member decreases with the result of reduction of the sealing property. Therefore, it is desirable that the friction is reduced on the surface 3*d* which is opposite from the surface on which the sealing member is bonded.

According to this embodiment, silicone oil, fluorine resin or paraffin wax, ultrahigh molecule polyethylene or the like is applied, painted or so on. Among them, silicone oil may be applied or a silicone coating film is bonded because of low cost and easy handling.

When the silicone oil is applied on the shutter surface 3*d*, the viscosity and the amount of application are controlled. As to the viscosity, if it is too low, the shutter jolts when it is opened or closed. If, on the contrary, it is too high, the applying operation to the shutter member is difficult. In consideration, according to the present invention, it is preferable that the viscosity is 100–10,000 cSt (centi-stokes), further preferably 1,000–5,000 cSt.

If the amount of application is too small, the formed oil film is not sufficient with the result of larger drag. If, on the contrary, it is too large, the applied surface may be so sticky that dust, toner or the like will be deposited thereon.

Accordingly, the amount of application is preferably 0.01 $mg/cm^2$–0.5 $mg/cm^2$, and further preferably, 0.05 $mg/cm^2$–0.1 $mg/cm^2$.

Embodiment 3

In this embodiment, 1.5 kg of the developer is accommodated in the main body 1 of the container, and the capping member 2 has an opening having a diameter of 60 mm. As for the material of the shutter 3, glass fiber reinforced polypropylene is used, which has the bending elasticity of approx. 52,000 $kg/cm^2$.

The material of the sealing member 4 is the same as Embodiment 1, and it is bonded to the shutter 3. It is assembled into the capping member 2, and is compressed by approx. 23%. The compression stress of the sealing member 4 is approx. 0.7 $kg/cm^2$.

In this embodiment, the silicone oil is applied to the surface 3*d* of the shutter member 3 remote from the surface 3*a* having the sealing member. The oil has a viscosity of 3,000 cSt, and the amount of application is approx. 0.1 $mg/cm^2$.

With this structure, 100 containers are actually manufactured, and the developer supply tests have been carried out. The drag is approx. 3–5 kg.f, and almost all of the developer in the container 1 has been supplied into the developer hopper 6. Usually, the operator uses the grip 3*c* of the shutter member 3, as shown in FIG. 3, when the operator opens and closes the shutter. Therefore, there is a tendency that a force is applied onto the top of the grip. In this case, the resistance against the sliding motion is increased between the capping member 2 and the bottom surface of the shutter 3, that is, the surface 3*d* remote from the sealing member bearing surface 3*a*. According to this embodiment, however, the increase of the drag can be prevented by the effect of the silicone oil application. Similarly to Embodiment 1, environment and transportation tests, image formation tests or the like are carried out, and it has been confirmed that no problem arises.

According to the foregoing embodiments, the sealing member is mounted to the shutter member to uniformly seal the gap between the shutter and the shutter guide, so that the size of the toner supply opening can be increased to the maximum, and the supply speed and the filling speed can be simultaneously increased. The shutter and the capping member may be downsized, and therefore, the size of the main assembly can be reduced. Since the sealing member is disposed in the shutter guide, the sealing property can be stably maintained. In addition, the shape of the sealing member is simple, and therefore, the sealing member can be bonded with high operativity.

According to the present invention, the following advantageous effects are provided.

(1) The size of the developer supply opening can be increased to the maximum in a limited range, and therefore, the toner supply speed and the developer filling speed are simultaneously increased.

(2) The shutter and capping member are compact, and therefore, the main assembly image forming apparatus is also made compact. Reduction of the sliding surface of the shutter is effective to lower the drag.

(3) The sealing member may be extended into the shutter guide, and the guide can be disposed right adjacent to the developer supply opening, and therefore, high sealing property can be stably maintained.

(4) Because of the simple configuration of the sealing member, the assembly operativity in the mounting of the sealing member is improved.

(5) The high sealing stabilization can be provided even in the case of large diameter opening and/or large capacity container.

(6) The drag upon the opening or closing of the shutter can be significantly reduced at low cost, and the operativity can be improved.

While the invention has been described with reference to the structures disclosed herein, it is not confined to the details set forth and this application is intended to cover such modifications or changes as may come within the purposes of the improvements or the scope of the following claims.

What is claimed is:

1. A developer supply container comprising:

a developer containing portion having an opening for supplying a developer therefrom;

shutter means for closing and opening the opening; and a guiding member for defining the opening and for guiding opening and closing motion of said shutter means, wherein said shutter means has a shutter and an elastic seal provided on said shutter and slidable on said guiding member.

2. A container according to claim 1, wherein said shutter means has a low friction property at a surface slidable on said guiding member.

3. A container according to claim 2, wherein said low friction surface has a friction coefficient of not more than 0.8.

4. A container according to claim 2, wherein said low friction surface is coated with oil to decrease the friction.

5. A container according to claim 4, wherein the oil has a viscosity of 100–10000 cSt, and an amount thereof is 0.01–0.5 mg/cm$^2$ on the surface.

6. A container according to claim 2, wherein said seal comprises a rubber and a low friction film slidable relative to said guiding member.

7. A container according to claim 1, wherein said seal comprises a rubber.

8. A container according to claim 7, wherein the rubber is a sponge.

9. A container according to claim 8, wherein the sponge is foamed urethane.

10. A container according to claim 1, wherein said seal is compressed between said guiding member and said shutter.

11. A container according to claim 10, wherein a compression stress of the seal is between 0.1–2.0 kg/cm$^2$, and preferably is between 0.6–1.5 kg/cm$^2$.

12. A container according to claim 10, wherein said shutter has a bending elasticity of between 20,000–100,000 kg/cm$^2$, and preferably between 50,000–80,000 kg/cm$^2$.

13. A container according to claim 10, wherein said guiding member and said shutter are of plastic resin material.

14. A container according to claim 13, wherein said shutter comprises glass fibers.

15. A container according to claim 1, wherein said shutter has a low friction material on such a side of said shutter as is opposite from a side thereof having said seal.

16. A container according to claim 1, wherein said seal extends between from one end to the other end with respect to a direction perpendicular to a movement direction of said shutter means.

* * * * *